US010441874B2

(12) United States Patent
Richter et al.

(10) Patent No.: US 10,441,874 B2
(45) Date of Patent: Oct. 15, 2019

(54) ELECTRONIC GAME BOARD SYSTEM COMMUNICATING AT LEAST ONE GAME-PLAY-DATA

(71) Applicants: Wolfgang Richter, Vancouver (CA); Faranak Zadeh, Vancouver (CA)

(72) Inventors: Wolfgang Richter, Vancouver (CA); Faranak Zadeh, Vancouver (CA)

( * ) Notice: Subject to any disclaimer, the term of this patent is extended or adjusted under 35 U.S.C. 154(b) by 499 days.

(21) Appl. No.: 14/603,799

(22) Filed: Jan. 23, 2015

(65) Prior Publication Data

US 2016/0214003 A1 Jul. 28, 2016

(51) Int. Cl.
*G06F 17/00* (2006.01)
*A63F 3/00* (2006.01)
*A63F 9/24* (2006.01)

(52) U.S. Cl.
CPC *A63F 3/00643* (2013.01); *A63F 2003/00662* (2013.01); *A63F 2009/2448* (2013.01); *A63F 2009/2486* (2013.01); *A63F 2009/2489* (2013.01); *A63F 2250/265* (2013.01)

(58) Field of Classification Search
None
See application file for complete search history.

(56) References Cited

U.S. PATENT DOCUMENTS 6,213,467 B1 * 4/2001 Andrews ..... A63F 3/00643 273/236
8,540,569 B2 * 9/2013 Orlinsky ..... A63F 3/00643 273/236
2012/0248699 A1 * 10/2012 Garcia ..... A63F 3/0052 273/242
2013/0069307 A1 * 3/2013 Ward ..... G09B 5/06 273/238

* cited by examiner

*Primary Examiner* — Ronald Laneau

(57) ABSTRACT

Disclosed is an electronic game board system communicating at least one game-play-data to an external device. The system includes a contactless communication unit (CCU), an electronic game board and one or more play items. The contactless communication unit communicates with the external device, and further provides alternating electric field. The electronic game board includes plurality of the play fields to receive the alternating electric field, wherein the playfields serially interconnected with each other. The play item capacitively transmits the game play data to the contactless communication unit. The contactless communication unit generates a processed-game-play-data defining a status of the play item placed on the play field, and the contactless communication unit further transmits the processed-game-play-data to the external device.

19 Claims, 8 Drawing Sheets

ELECTRONIC GAME BOARD SYSTEM COMMUNICATING AT LEAST ONE GAME-PLAY-DATA

CROSS-REFERENCE TO RELATED APPLICATION

This application is a continuation-in-part of CIP application Ser. No. U.S. Ser. No. 13/779,766 filed on Feb. 28, 2013, which claims its priority from the non-provisional application Ser. No. U.S. Ser. No. 13/174,584 filed on Jun. 30, 2011. The non-provisional application Ser. No. 13/174,584 claims priority to U.S. Provisional Application No. 61/360,099 filed on Jun. 30, 2010, the entire contents of which are incorporated herein by references in its entirety.

DESCRIPTION OF RELATED ART

1. Field of the Invention

The present invention generally relates to an electronic game board system, and more particularly relates to a matrix-free electronic gaming system and method for communicating game-play-data to an external device.

2. Background of the Invention

Although board games have a long history over the centuries, more and more users have recently been attracted to consoles and computer games as a result of their interactivity and endless variants. In order to enhance the playing features, many board games have been equipped with electronic elements. Some of them use digital display technology as well as sound and/or light effects. Electronic dice are common in recent games as well as board games containing RFID technologies for identifying tokens or players or playing cards or other items. The virtual world offers plenty of board game simulations for PC game consoles and online gaming. Some are labeled as Casino Games, which perform electronic roulette or other board games for gambling purposes.

Social networks and online games allow users to play with others over a distance; such features cannot be afforded by traditional board games. Chess players have used traditional mail in the past. Also, board games cannot compete with the effects that console or PC games provide. The task is of interfacing existing board games with PCs in order to maintain the physical look and experience while incorporating the electronic possibilities presents a challenge. Virtual software board games exist, but still there is a challenge to increase the interest of user by displaying the visual indicia of the play item and the game board on the communicating device such as tablet, IPad, and PDAs.

Though these high-end devices operate either on AC power or battery, thus there is a need of a device that could save electricity. This invention illustrates ways to make the play item and the electronic board game capacitively powered by the communication device. Further, illustrates a way to provide the interactive game-play-data from the communication device to the external device so that the game play performed on the electronic board games maybe viewed and stored in the communication device.

SUMMARY OF THE INVENTION

In accordance with the teachings of the present invention, an electronic gaming system and a method for communicating game-play-data to at least an external device, is provided. The system includes a contactless communication unit (CCU), one or more play items, and an electronic game board. The contactless communication unit communicates with the external device, and further provides alternating electric field.

The electronic game board includes plurality of the play fields to receive the alternating electric field, wherein the playfields serially interconnected with each other. The play items capacitively transmits the game-play-data to the contactless communication unit. The contactless communication unit generates a processed-game-play-data defining a status of the play item placed on the play field, and further transmits the processed-game-play-data to the external device.

The contactless communication unit includes a generator, a first converter, a first electrode, a memory unit, an interface, a controller unit and a wireless transceiver. The generator receives power from a DC source for generating a low level alternating voltage. The first converter shifts the low level alternating voltage received from the generator to high level alternating voltage. The first electrode is connected to the first converter for emitting high level alternating electric field of fixed frequency.

The memory unit stores reference data associated with each of the play item and the electronic game board. The interface receives the game-play-data from the play item caused by the user interaction. The controller unit processes the game-play-data received from the interface by comparing the reference data with the game-play-data and further transmits the processed game-play-data to the interface. The wireless transceiver bi-directionally communicates the processed-game-play-data received from the controller unit to the external device.

The play item includes a second electrode, a floating electrode, a second converter, a buffer, a detection unit, and a modulator. The second electrode receives the alternating electric field emitted from the first electrode, and further receiving gesture signal of the user. The floating electrode floats the alternating electric field to the ground for forming a closed electric circuit with at least one of: the CCU, and the user.

The second converter converts the alternating voltage received from the second electrode to the direct voltage. The buffer stores the direct voltage received from the second converter. The detection unit detects the game-play-data associated with at least one surface of the play item, position of the play item on the play field, and a first identification information of the play item. The modulator modulates the alternating electric field influenced by the first electrode with the detected data, and further transmits the modulated data to the interface.

An object of the present invention is to provide the detection unit that includes a first Schmitt trigger, a second Schmitt trigger and a counter. The first Schmitt trigger generates a clock signal on receiving the alternating voltage of the second electrode. The second Schmitt trigger generates a pulse signal having time interval associated with the electric field strength in between the play item and the play field. The counter is connected to the first Schmitt trigger and the second Schmitt trigger for generating a digital value indicating the surface information of the play item and the position information of the play item.

Another object of the present invention is to provide the contactless communication unit includes a display unit to display the processed-game-play-data defining the status of the play item.

Another object of the present invention is to provide the system includes a player communication unit (PCU) integrated with a wearable article of the user to transmit the second identification information and gesture information associated with the user.

Another object of the present invention is to provide the controller unit further sends a command data to the play item through the interface for signalizing the status of the play item and the player communication unit (PCU).

Another object of the present invention is to provide the memory unit further stores the processed-game-play-data associated with the game play performed by the user.

Another object of the present invention is to provide the play item further comprising: an optical unit to generate an optical signal for signaling the status of the play items; a vibration unit to cause a vibration signal for signaling the status of the play items; and an audio unit to generate an audio signal for signaling the status of the play items.

BRIEF DESCRIPTION OF THE DRAWINGS

The disclosure will provide details in the following description of preferred embodiments with reference to the following figures wherein.

Figure 1A:
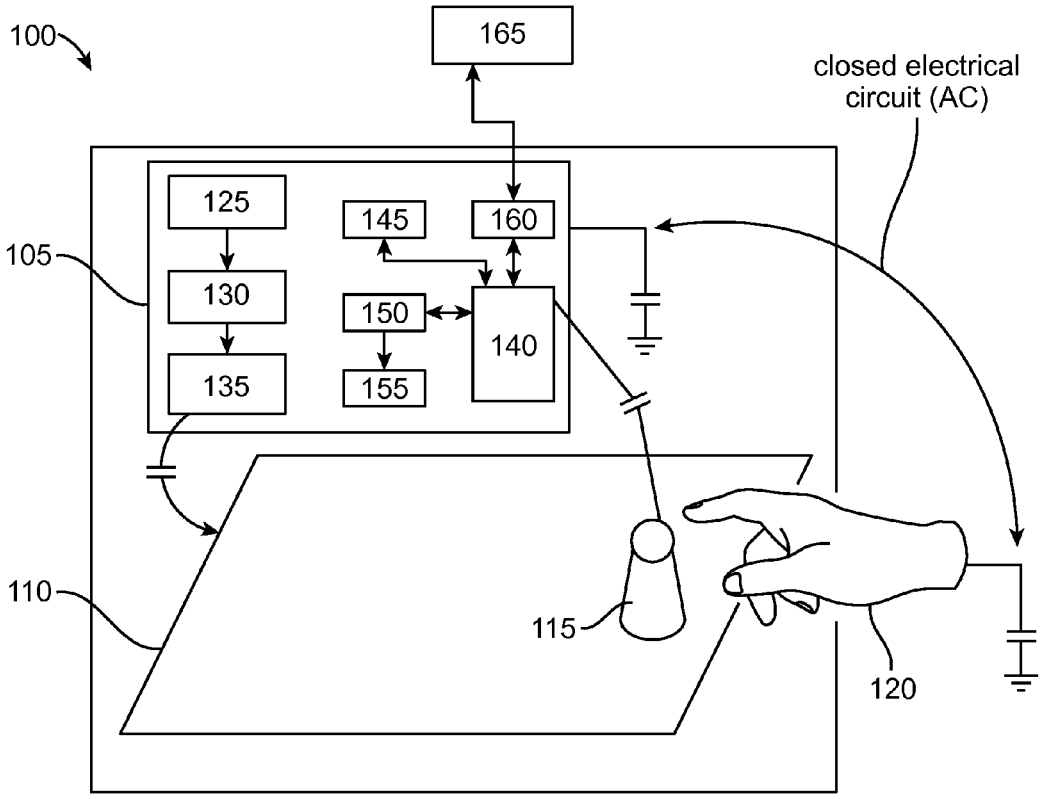
FIG. 1A illustrates network architecture of an electronic gaming system, in accordance with a preferred embodiment of the present invention.

The foregoing summary, as well as the following detailed description of certain embodiments of the present invention, will be better understood when read in conjunction with the appended drawings. For the purpose of illustrating the invention, certain embodiments are shown in the drawings. It should be understood, however, that the present invention is not limited to the arrangements and instrumentality shown in the attached drawings.

DETAILED DESCRIPTION OF THE INVENTION

While this technology is illustrated and described in a preferred embodiment, electronic gaming system may be produced in many different configurations, forms and materials. There is depicted in the drawings, and will herein be described in detail, as a preferred embodiment of the invention, with the understanding that the present disclosure is to be considered as an exemplification of the principles of the invention and the associated functional specifications for its construction and is not intended to limit the invention to the embodiment illustrated. Those skilled in the art will envision many other possible variations within the scope of the technology described herein.

Reference will now be made in detail to several embodiments of the invention which are illustrated in the accompanying drawings. Wherever feasible and convenient, the same reference numerals are used in the figures and the description to refer to the same or like parts. The drawings are in a simplified form and not to precise scale. For purposes of convenience and clarity only, directional terms, such as top, bottom, left, right, up, down, over, above, below, beneath, rear, and front may be used with respect to the accompanying drawings.

These and similar directional terms should not be strictly construed to limit the scope of the invention. In addition, words such as attached, affixed, coupled, connected and similar terms with their inflectional morphemes are used interchangeably, unless the difference is noted or made otherwise clear from the context. These words and expressions do not necessarily signify direct connections, but include connections through mediate components and devices.

FIG. 1A illustrates network architecture of an electronic game board system 100 communicating at least one game-play-data to an external device 165. The system 100 includes a contactless communication unit 105, an electronic game board 110, and one or more play items 115. The contactless communication unit 105 communicates with the external device 165, and further provides alternating electric field. The electronic game board 110 having plurality of the play fields to receive the alternating electric field. Examples of the external device 165 may include but not limited to mobile phone, TV, personal computer, portable computer including laptop computer and notebook computer, and personal digital assistant.

The play fields are serially interconnected with each other. The play items 115 capacitively transmits the game-play-data to the contactless communication unit 105. The contactless communication unit 105 generates a processed-game-play-data defining a status of the play item 115 placed on the play field. Further, the contactless communication unit 105 transmits the processed-game-play-data to the external device 165. The play fields are explained in detail in conjunction with the FIG. 1B.

The contactless communication unit 105 includes a generator 125, a first converter 130, a first electrode 135, an interface 140, a memory unit 145, a controller unit 150, and a wireless transceiver unit 160. The generator 125 receives power from a DC source for generating a low level alternating voltage. Examples of the generator 125 includes but not limited to an oscillator, a thermoelectric generator, and electromagnetic coils. The first converter 130 shifts the low level alternating voltage received from the generator 125 to a high level alternating voltage.

Example of the first converter 130 includes but not limited to a level shifter. However, it will be readily apparent to those with ordinary skill in the art that the various other types of the generator 125 and the first converter 130 may also be used for generating electric voltage and shifting the alternating voltage, respectively without deviating from the scope of the present invention.

The first electrode 135 is connected to the first converter 130 for emitting high level alternating electric field of specific frequency. Examples of the first electrode 135 includes but not limited to a conductive surface. The memory unit 145 stores a reference data associated with the play items 115 and the electronic game board 110. The surface information, position information and identification information of the play item 115 are stored as the reference data. Examples of memory unit 145 includes but not limited to SD Flash ROM, memory card and other similar devices.

The interface 140 receives the game-play-data from the play item 115 caused by the user interaction. The interface 140 receives the plurality of game-play-data in the form of an analog signal and further converts the received analog signal into a digital signal i.e. digitized game-play-data. Example of interface 140 includes but not limited to electronic switches, analog to digital conversion (ADC) and digital to analog conversion (DAC).

The controller unit 150 processes the game-play-data received from the interface 140 by comparing the reference data with the game-play-data. In the preferred embodiment of the present invention, the controller unit 150 may be a finite state machine which may be implemented as hardware or a software running on a processor or combinations of the two. The finite state machine provides the condition/status of the play item 115 based on the progression of the game play performed by the user 120.

Figure 1B:
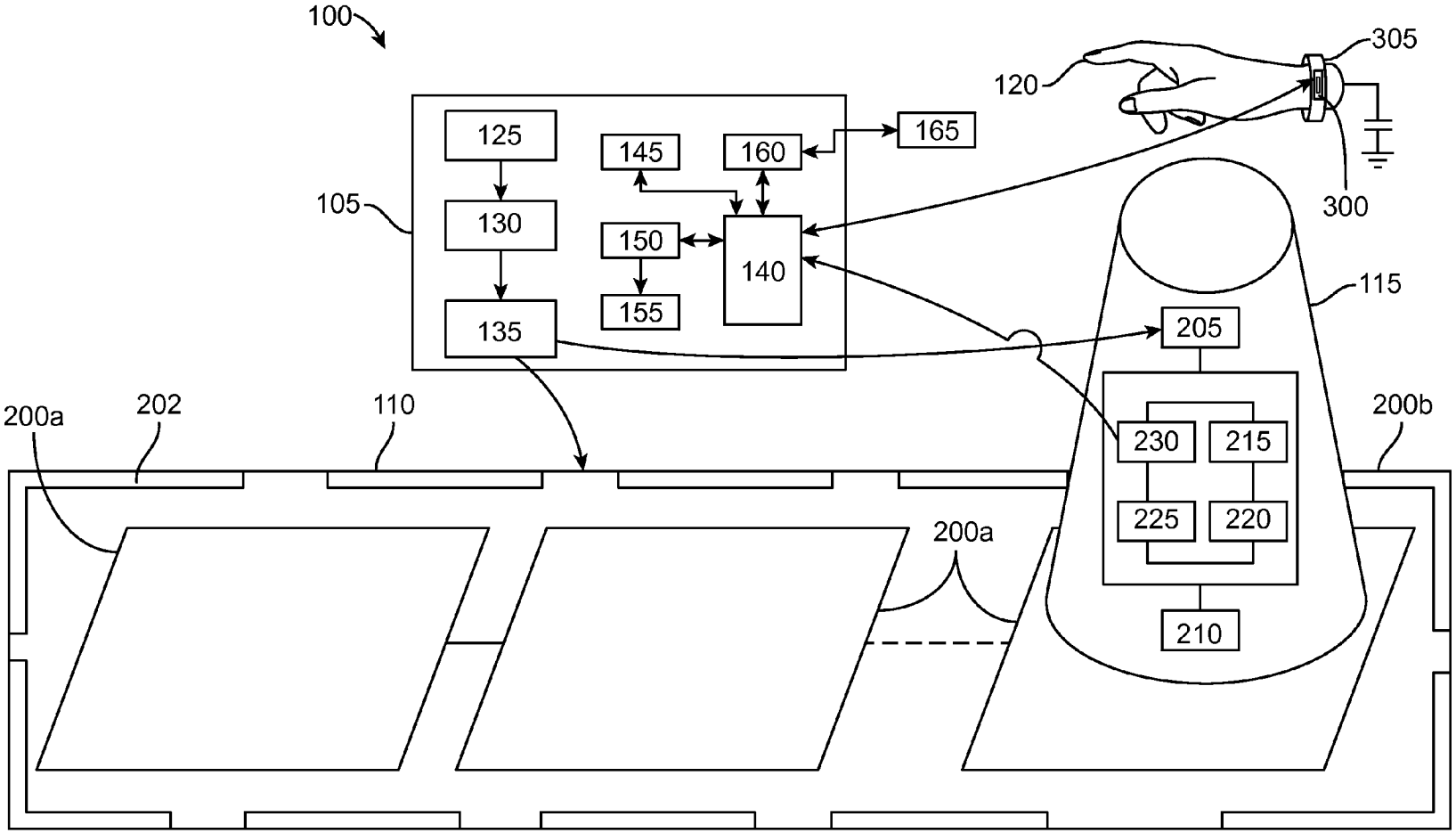
FIG. 1B illustrates the play item placed on the electronic game board, and the player communication unit (PCU) communicating with the contactless communication unit, in accordance with a preferred embodiment of the present invention.

FIG. 1B illustrates the play item 115 placed on the electronic game board 110 communicating with the contactless communication unit 105, in accordance to the present invention. The play item 115 includes a second electrode 205 i.e. conductive electrode, a floating electrode 210, a second converter 215, a buffer 220, a detection unit 225 and a modulator 230.

The second electrode 205 i.e. conductive electrode receives the alternating electric field emitted from the first electrode 135, and further receives the gesture signal of the user 120. The floating electrode 210 floats the electric field received from the first electrode 135 to the ground, so as to form a closed electric circuit with at least one of: the contactless communication unit 105; and the user 120. Examples of the second electrode 205 and the floating electrode 210 include but not limited to any conductive surface.

The second converter 215 converts the alternating voltage received from the second electrode 205 into a direct voltage. Example of the second converter 215 may be a rectifier, inductor, resonator, cascade, diode bridges, transformer, and level shifter. The buffer 220 stores the direct voltage received from the second converter 215. Examples of the buffer 220 include but not limited to capacitor, and accumulator. As an example, a 5.5 V/1 F Panasonic "super capacitor" specifies a voltage drop at 20° C. from 5.5 V down to 3 V in 600 hours (25 days or 3.6 weeks) for a double cell capacitor.

The detection unit 225 detects the game-play-data associated with at least one surface information, the position information, and a first identification information of the play item 115. The detection unit 225 detects the game-play-data when the closed electrical circuit is formed in between the play item 115 and the user 120. The detection unit 225 is explained in detail in conjunction with the FIG. 2B and FIG. 2C of the present invention.

The modulator 230 modulates the alternating electric field influenced by the first electrode 140 with the detected data, and further transmits the modulated data to the interface 140. The controller unit 150 receives the modulated data and further processes the modulated data based on the reference data stored in the memory 145. The signal transmitted by the modulator 230 may be modulated using any modulation technique.

Examples of the modulation technique include but not limited to analog modulation such as AM, FM, PM, QAM, SM, digital modulation such as ASK, APSK, CPM, FSK, MFSK, MSK, OOK, PPM, PSK, QAM, SC-FDE, TCM and spread spectrum such as CSS, DSSS, FHSS, THSS. The entire electric circuitry such as the second electrode 205, the floating electrode 210, the second converter 215, the buffer 220, the detection unit 225, and the modulator 230 of the play item 115 may be embedded in a single chip or in a printed decal or on a flexible polymer foil.

The controller unit 150 outputs the processed game-play-data to define the status of the play item 115. The wireless transceiver 160 is bi-directionally communicating the processed-game-play-data to the external device 165. The processed-game-play-data defining the image of the play item 115 and the electronic game board 110 is displayed in the external device 165. Examples of wireless transceiver unit 116 include but not limited to Bluetooth, Wi-Fi, Ethernet, frame relay, devices supporting ATM/SONET and devices supporting internet protocols.

In another preferred embodiment of the present invention, the display unit 155 displays the processed-game-play-data defining the status of the play item 115. Example of display unit 155 includes but not limited to touch panel screen of the mobile phone, LED display, OLED display, and other similar display devices.

In another preferred embodiment of the present invention, the system 100 further includes a bi-directional player communication unit (PCU) 300 integrated to a wearable article 305 such as a wristband of the user 120 for communicating with the contactless communication unit 105, in accordance with the present invention.

The player communication unit (PCU) 300 transmits the second identification information and gesture information associated with the user 120 and further receives the command data signalizing the status of the play item 115 from the controller unit 150 through the interface 140. Thus, the player communication unit 300 works bi-directionally. Examples of the wearable articles 305 include but not limited to an ear-plug, a headband, a glove, a ring, and a clip attachable to the user 120. The user 120 is identified as anonymous user, when the user 120 initiates the game play without any player communication unit 300.

The second identification information indicates the identity information of the user 120 for enabling the contactless communication unit 105 to identify the user 120. The gesture information indicates the user location and the user proximity relative to the play item 115 placed on the play field 200*a*. The detection of the second identification information and gesture information is explained in detail in conjunction with the FIG. 2B of the present invention.

In the preferred embodiment of the present invention, the plurality of the play fields 202 are positioned along the outer peripheral edges of the electronic game board 110. The play fields 202 are the conductive traces that receive the alternating electric field emitted from the first electrode 140. The electric field is bridged in between the PCU 300 and the play field 202 to detect the gesture information of the user 120.

The PCU 300 includes an electronic circuitry that is similar to that of the circuitry incorporated in the play item 115. The PCU 300 further transmits the detected second identification information and gesture information associated with the user 120 to the interface 145. The controller unit 150 determines the user's identity and user's gesture based on the reference data stored in the memory unit 160. For example, from the gesture information, the CCU 105 identifies whether the user 120 approaches the play item 115 from the north direction or south direction or east direction or west direction.

In another preferred embodiment of the present invention the PCU 300 is integrated with a wearable article such as the ear-plug. For example, the PCU 300 transmits the second identification information indicating identified-user as e.g. Tom and the user's gesture information as "Tom approaching the play item 115 from east direction of the game board". The CCU 105 sends the command data associated with the play item 115 and the user to the PCU 300. The ear-plug integrated to the PCU 300 plays an audio signal to signalize the user information as "Tom" and the user's gesture information as "Tom approaching the play item 115 from east direction of the game board".

Figure 2A:
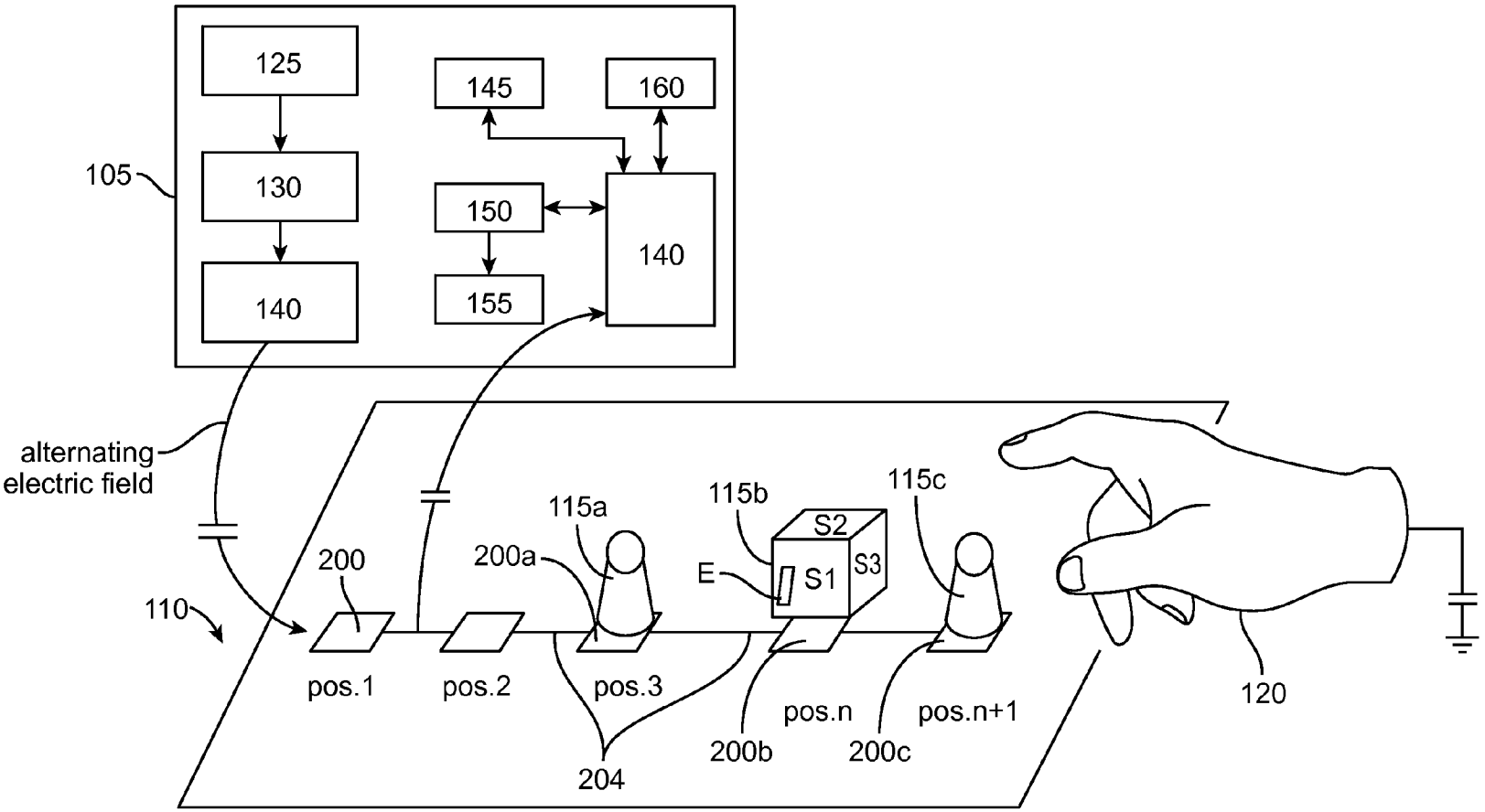
FIG. 2A illustrates network architecture of the one or more play items placed on the one or more electronic game boards, in accordance with a preferred embodiment of the present invention.

FIG. 2A illustrates the network architecture of the one or more play items 115*a*, 115*b*, 115*c* placed on the playfields 200*a*, 200*b*, and 200*c* respectively, and communicating with the contactless communication unit 105. The electronic game board 110 further includes printed lines 204 to indicate connectivity between the one or more playfields 200*a*, 200*b*, and 200*c*.

In an exemplary embodiment, the voltage ratio of the play item 115*a* placed on the first playfield 200*a* is 99% and the voltage ratio of the play item 115*c* placed on the last playfield 200*c* is 1%. The detection of voltage ratio of the play item 115 to the play field 200 is explained in detail in conjunction with FIG. 2C.

As shown, the play items 115, such as pawns 115*a*, 115*c*, and dice 115*b* having surface S1-S3 (Visible), S4-S6 (not shown in FIG. 2A). However it is readily apparent to those skilled in the art that various play items 115 such as action figures, play stones, play cards, dice, miniatures (houses in monopoly) may be envisioned without deviating from the scope of the present invention. For example, the dice 115*b* having 6 surfaces (as shown in FIG. 2A), one or more second electrodes E are arranged along the respective surfaces S1-S6 of the play item 115*b*.

In the preferred embodiment of the present invention, the dice surface S4 is in contact with the play field 200*b*. When the dice surface S4 is in contact with the play field 200*b* then the electric field strength in between the play field 200*b* and the electrode E2 integrated with the dice surface S4 is greater. Hence, the dice 115*b* is detected to be closer to the play field 200*b*. Similarly, the play item 115*a* is detected closer to the play field 200*a*, and the play item 115*c* is detected closer to the play field 200*c*.

Figure 2B:
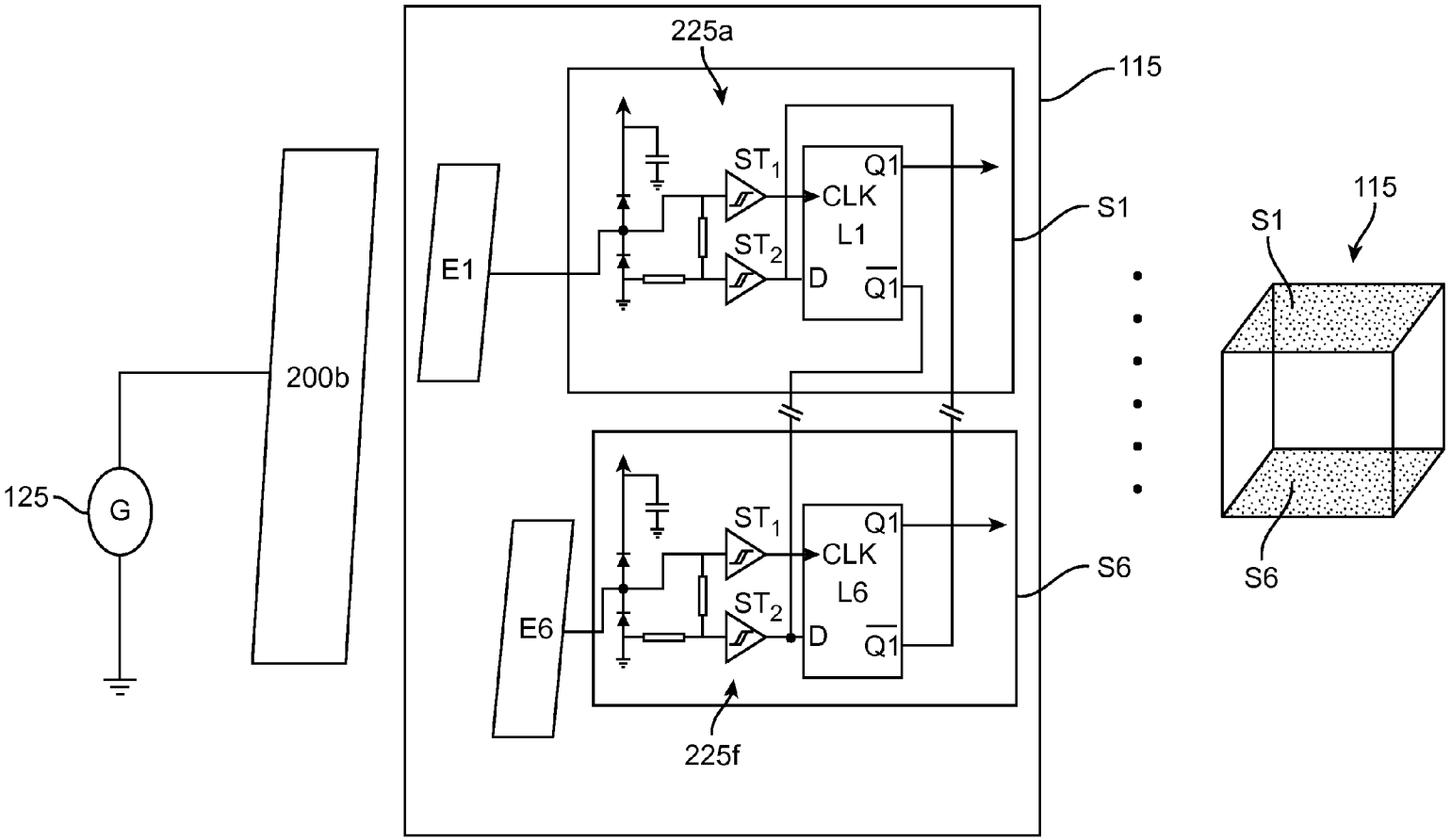
FIG. 2B illustrates detection unit for detecting the surface of the play item coupled to the electronic game board, in accordance with a preferred embodiment of the present invention.

FIG. 2B illustrates the circuitry of the detection unit 225 to detect the surface of the play item 115 in contact with the play field 200*b*. In the preferred embodiment of the present invention, the play item 115 is a dice with multiple surfaces, wherein at least one detection unit 225 is attached to the second electrodes of the play item 115.

For exemplary purposes, the play item 115 has six detection units 225*a*-225*f* attached to the second electrodes E1-E6 at the surfaces S1-S6 of the play item 115 respectively. The detection unit 225*a* includes a first Schmitt trigger ST1, a second Schmitt trigger ST2, and a counter L1. The first Schmitt trigger ST1 generates a clock signal on receiving an analog input which is the alternating voltage of the second electrode E1 at surface S1 of the play item 115.

The second Schmitt trigger ST2 generates a pulse signal having time interval associated with the electric field strength in between the second electrode E1 of the play item 115 and the play field 200*b*. The counter L1 e.g. D-flip flop counter is connected to the first Schmitt trigger ST1, and the second Schmitt trigger ST2. The counter L1 counts the digital value that represents the electric field strength in between the play field 200*b* and the second electrode E1 of the play item 115.

Similarly, the other detection units 225*b*-225*f* output the digital value that represents the electric field strength in between the play field 200*b* and the second electrodes E2-E6 of the play item 115 respectively.

The modulator (not shown in FIG. 2B) receives the digital value from the counter L1-L6, and further sends the modulated digital code to the controller unit (not shown in FIG. 2B) through the interface (not shown in FIG. 2B). The controller unit detects the orientation of the play item 115 on the play field 200*b*. In a preferred embodiment of the present invention, the display unit (not shown in FIG. 2B) or the external device (not shown in FIG. 2B) further displays the top surface of the play item 115 on the play field 200*b*.

For an example, the dice surface S1 is having one spot representing a dice-thrown-value as one, the dice surface S2 is having two spots representing a dice-thrown-value as two, the dice surface S3 having three spots representing a dice-thrown-value as three, the dice surface S4 having four spots representing a dice-thrown-value as four, the dice surface S5 having five spots representing a dice-thrown-value as five, and the dice surface S6 having six spots representing a dice-thrown-value as six.

For exemplary purposes the digital output of the detection units 225*a*-225*f* in contact with the play field 200*b* are shown in the below table 1. The counter output L1-L6 versus various conditions associated with the play item 115 is illustrated in the below table.

| | L1 o/p at S1 | L2 o/p at S2 | L3 o/p at S3 | L4 o/p at S4 | L5 o/p at S5 | L6 o/p at S6 | Counter O/P (L1-L6) | Dice-thrown value |
|---|---|---|---|---|---|---|---|---|
| Condition 1: S1in contact with playfield | 1 | 0 | 0 | 0 | 0 | 0 | 100000 | 6 |
| Condition 2: S2 in contact with playfield | 0 | 1 | 0 | 0 | 0 | 0 | 010000 | 4 |
| Condition 3: S3 in contact with playfield | 0 | 0 | 1 | 0 | 0 | 0 | 001000 | 5 |
| Condition 4: S4 in contact with playfield | 0 | 0 | 0 | 1 | 0 | 0 | 000100 | 2 |
| Condition 5: S5 | 0 | 0 | 0 | 0 | 1 | 0 | 000010 | 3 |

-continued

| | L1 o/p at S1 | L2 o/p at S2 | L3 o/p at S3 | L4 o/p at S4 | L5 o/p at S5 | L6 o/p at S6 | Counter O/P (L1-L6) | Dice-thrown value |
|---|---|---|---|---|---|---|---|---|
| in contact with playfield | | | | | | | | |
| Condition 6: S6 in contact with playfield | 0 | 0 | 0 | 0 | 0 | 1 | 000001 | 1 |

When the dice surface S1 is in contact with the play field 200*b*, the dice surface S6 is on the top. The controller unit identifies the top dice surface S6 is oriented opposite to the dice surface S1 based on the digital code (100000) as illustrated in the above table. The controller unit outputs the surface information indicating a dice-throw-value as 6 and the identity of the play item 115 as dice to signalize the status of the thrown play item 115. The display unit (not shown in FIG. 2B) displays the dice surface S6 having six spots to signalize the status of the thrown play item 115.

In other preferred embodiment the detection unit 225 includes a shift register to receive the digital value from the counter L1-L6, when the dice surface S1 is in contact with the play field 200. The shift register further shifts the digital output into a digital code e.g. Manchester code indicating at least one of the identification number and the surface information of the play item 115.

Figure 2C:
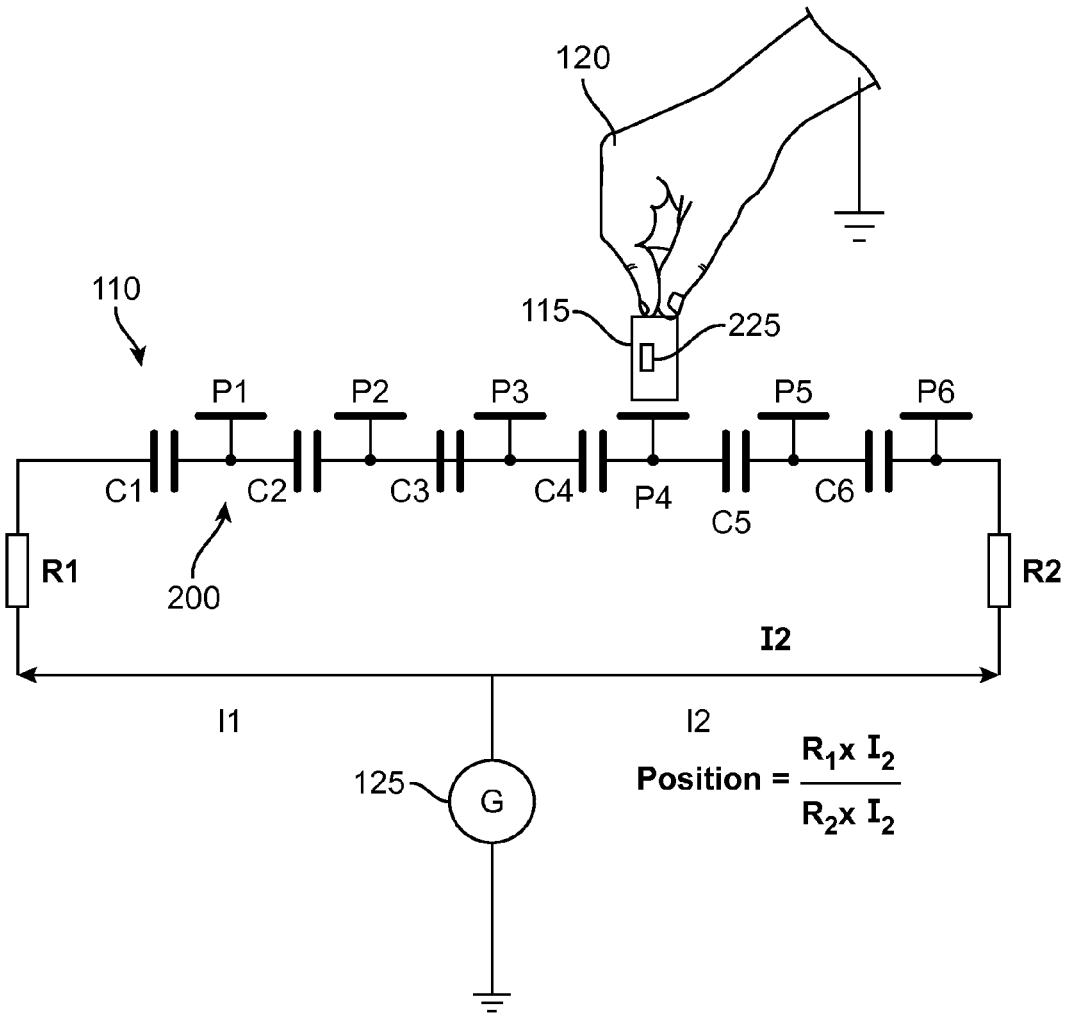
FIG. 2C illustrates the detection unit for detecting the position of the play item on the electronic game board, in accordance with a preferred embodiment of the present invention.

FIG. 2C illustrates the detection unit 225 for detecting the position of the play item 115. The contactless communication unit (not shown in FIG. 2C) stores the reference data associated with the position information P1-P6 of the play fields 200. The playfields 200 function as serial capacitance C1-C6 to feed the electric field in from all sides of the play item 115. The playfields at position P1-P6 may be arranged in any matrix-free linear format.

The detection unit 225 measures voltage ratio of the one or more second electrodes of the play item 115 to the play field 200. The detection unit 225 detects the position of the play item 115 placed on the position P4 of the play field 200 based on the voltage ratio of the play item 115.

The voltage ratio is calculated by the following formula:

$$\text{Position information=voltage ratio of the play item 115}=(R1\times I1)/(R2\times I2),$$

Where,

R1=resistance value at the resistor connected to position P1 of the first play field;

I1=current value across the resistance R1 connected to position P1 of the first play field;

R2=resistance value at the resistor connected to position of the last play field;

I2=current value across the resistance R2 connected to position n+1 of the last play field.

For example, the user 120 moves the play item 115 to different positions such as P4, P5 and P6 during the game play. Then the voltage ratio of the play item 115 is 70% at the position P4, the voltage ratio of the play item 115 is 50% at the position P5, and the voltage ratio of the play item 115 is 30% at the position P6. The detection unit 225 transmits the detected position information of the play item 115 to the interface of the contactless communication unit (not shown in FIG. 2C).

Further the controller unit (not shown in FIG. 2C) processes the game-play-data associated with the position information of the play item 115. The controller unit outputs the position information of the play item 115 as P4. In the preferred embodiment of the present invention, the display unit (not shown in FIG. 2C) or the external device (not shown in FIG. 2C) displays a visual indica of the play item 115 at the position P4 of the play field 200.

Figure 3:
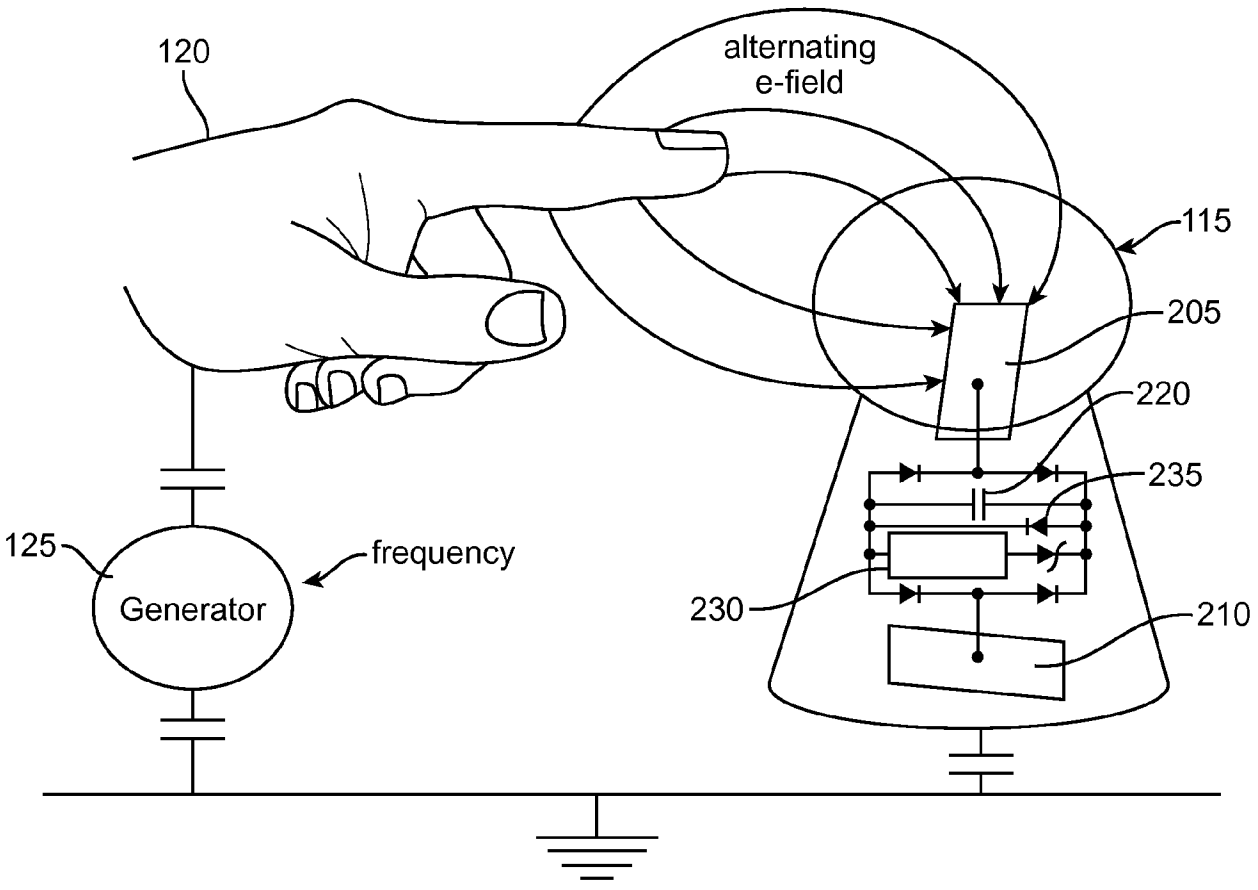
FIG. 3 illustrates the formation of closed electrical circuit between the one or more play items and one or more user.

FIG. 3 illustrates the formation of closed electrical circuit in between the play item 115 and the user 120. The play item 115 further includes an optical unit 235 to generate an optical signal for signaling the status of the play items 115. Example of the optical unit include but not limited to a light emitting diode, neon lights etc. The status of the play items 115 is explained in detail in conjunction with the FIG. 2A and FIG. 2B of the present invention.

The optical unit 235 illuminates the light upon the gesture/proximity information of the user 120 detected by the detection unit (not shown in FIG. 3). In the preferred embodiment of the present invention, if the play item 115 is approached by the user, then the optical unit 235 illuminates the light with low intensity. If the play item 115 is touched by the user, then the optical unit 235 illuminates the light with high intensity.

In another preferred embodiment of the present invention, the play item 115 further includes a vibration unit to cause a vibration signal for signaling the status of the play items, and an audio unit to generate an audio signal for signaling the status of the play items. Example of the vibration unit includes but not limited to a piezoelectric vibrator, and example of the audio unit includes but not limited to a speaker.

Figure 4:
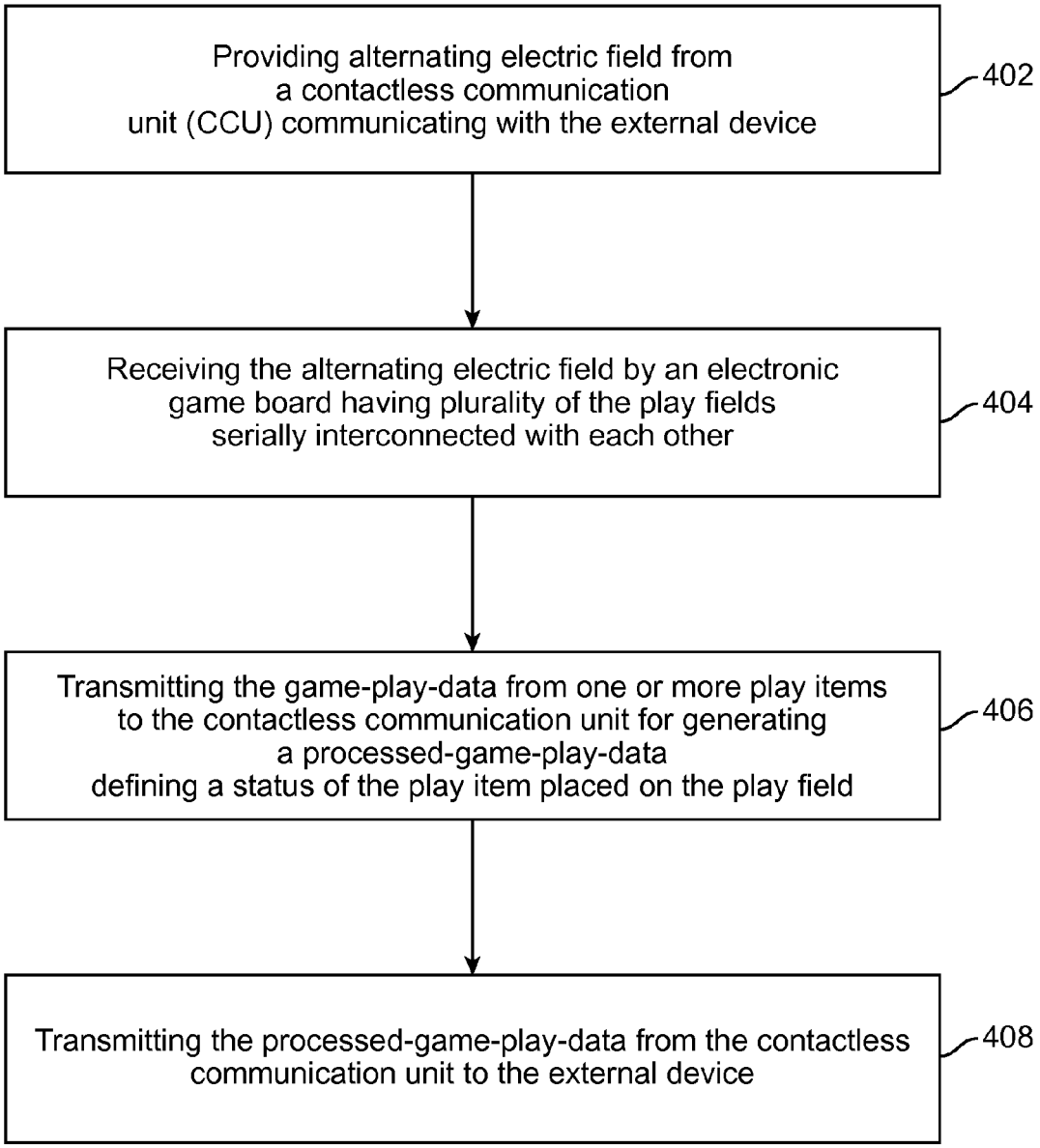
FIG. 4 illustrates the flowchart of electronic gaming method for communicating game-play-data to at least an external device, in accordance with a preferred embodiment of the present invention.

FIG. 4 illustrates the flow chart illustrating the electronic gaming method 400 for communicating game-play-data to at least an external device. The method 400 initiates with the step 402 of providing alternating electric field from a contactless communication unit (CCU) communicating with the external device. The step 402 is followed by a step 404 of receiving the alternating electric field by an electronic game board having plurality of the play fields serially interconnected with each other.

The step 404 is followed by a step 406 of transmitting the game-play-data from one or more play items to the contactless communication unit for generating a processed-game-play-data defining a status of the play item placed on the play field. The step 406 is followed by a step 408 of transmitting the processed-game-play-data from the contactless communication unit to the external device.

Figure 5:
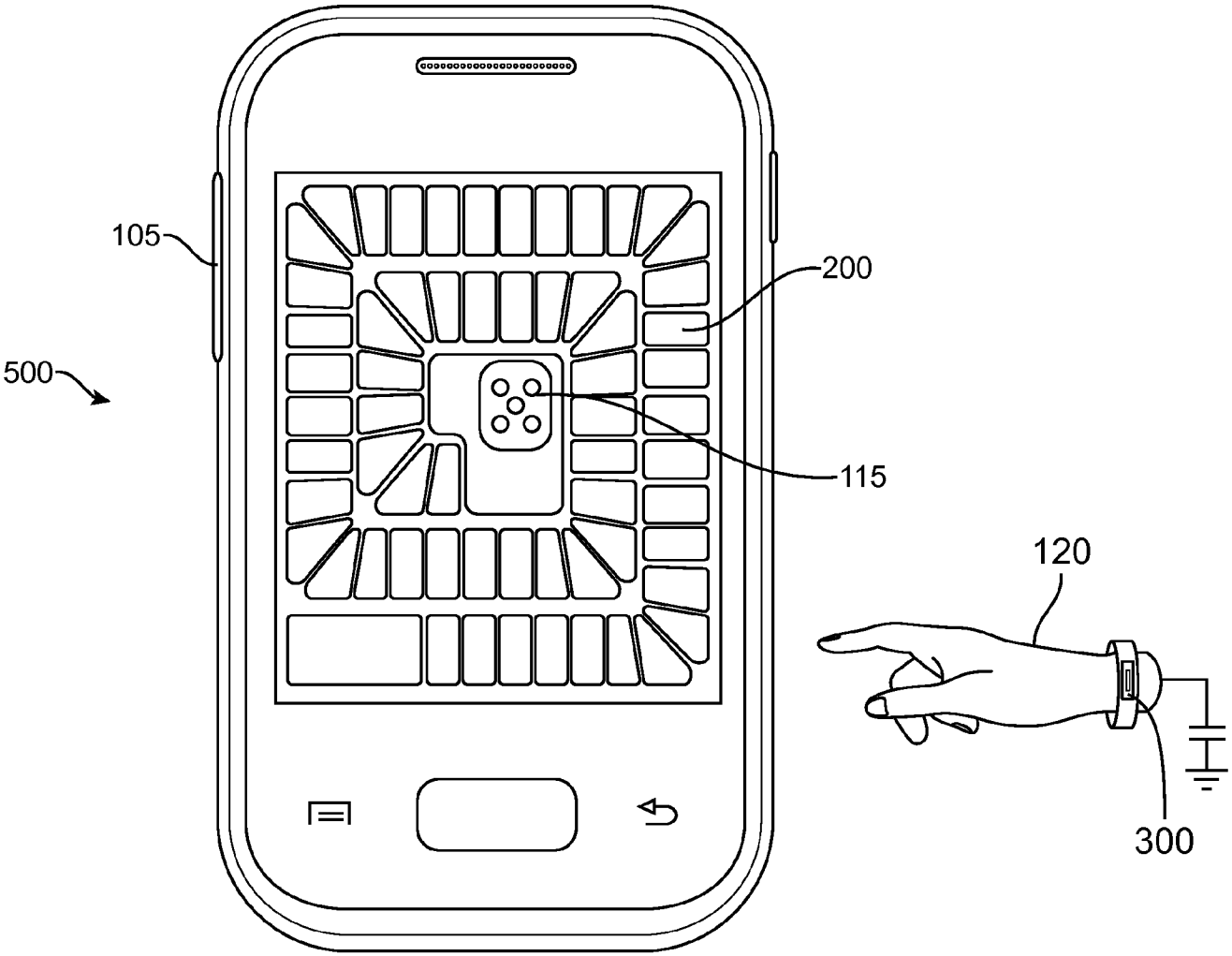
FIG. 5 illustrates the electronic game system communicating game-play-data in between the contactless communication unit and the one or more play items, in accordance to other preferred embodiment of the present invention.

FIG. 5 illustrates the electronic game system 500 communicating game-play-data in between the contactless communication unit (CCU) 105 and the one or more play items 115, in accordance to other preferred embodiment of the present invention. The system 500 allows the user 120 to perform the game play by the CCU 105, the play item 115, and the player communication unit 300. Example of the CCU 105 includes but not limited to a mobile phone, a smart phone, a phablet, a tablet and a smart watch.

The CCU 105 displays plurality of play fields 200 associated with a game, to perform a game play by the user 120.

The play item 115 are placed on the play fields 200 displayed on the contactless communication unit 105. Further the play items 115 are capacitively coupled to the CCU 105.

The play item 115 communicates the game-play-data to the interface (not shown in FIG. 5) of the CCU 105 when the play item 115 is moved on the play field 200 by the user 120. In the exemplary embodiment, the user 120 is wearing a wearable article integrated with a player communication unit (PCU) 300 to transmit the second identification information and gesture information associated with the user 120.

The controller unit (not shown in FIG. 5) of the CCU 105 processes the game-play-data received from the interface (not shown in FIG. 5). The controller unit further transmits the processed game-play-data such as surface information, the position information and the identification information of the play item 115 to the interface (not shown in FIG. 5).

In an exemplary embodiment of the present invention, the display unit (not shown in FIG. 5) or the external device displays the processed-game-play-data defining the status of the play item 115 received from the interface (not shown in FIG. 5). The features and function of the CCU 105, the play item 115, the player communication unit (PCU) 300 are explained in detail in conjunction with the FIG. 1A and FIG. 1B.

In this embodiment, the system 500 further includes an electronic game board (not shown in FIG. 5) to receive the alternating electric field from the CCU 105. The play items 115 placed on the electronic game board transmit the game-play-data to the CCU 105. The features and function of the electronic game board are explained in detail in conjunction with the FIG. 1A.

There has thus been shown and described the electronic gaming system and method for providing interactive game-play-data to at least an external device. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

The invention claimed is:

1. An electronic game board system communicating at least one game-play-data to an external device, the system comprising:

a contactless communication unit to communicate with the external device, and further to provide alternating electric field, wherein the contactless communication unit comprising;

a generator to receive power from a DC source for generating a low level alternating voltage;

a first converter to shift the low level alternating voltage received from the generator to high level alternating voltage;

a first electrode connected to the first converter for emitting high level alternating electric field of fixed frequency;

a memory unit to store reference data associated with each of the play item and the electronic game board;

an interface to receive the game-play-data from the play item caused by the user interaction;

a controller unit to process the game-play-data received from the interface by comparing the reference data with the game-play-data and further transmits the processed game-play-data to the interface; and a wireless transceiver to bi-directionally communicate the processed-game-play-data received from the controller unit to the external device;

an electronic game board having plurality of the play fields to receive the alternating electric field, wherein the playfields serially interconnected with each other; and one or more play items capacitively transmits the game play data to the contactless communication unit for generating a processed-game-play-data defining status of the play item placed on the play field, wherein the contactless communication unit transmits the processed-game-play-data to the external device, wherein the external device processes, stores and displays the game play data.

2. The system according to claim 1, wherein the play item comprising:

a second electrode to receive the alternating electric field emitted from the first electrode, and further receiving gesture signal of the user;

a floating electrode to float the alternating electric field to the ground for forming a closed electric circuit with at least one of: the CCU; and the user;

a second converter to convert the alternating voltage received from the second electrode to the direct voltage;

a buffer to store the direct voltage received from the second converter;

a detection unit to detect the game-play-data associated with at least one surface of the play item, position of the play item on the play field, and a first identification information of the play item; and a modulator to modulate the alternating electric field influenced by the first electrode with the detected data, and further transmits the modulated data to the interface.

3. The system according to claim 1, wherein the contactless communication unit comprising a display unit to display the processed-game-play-data defining the status of the play item.

4. The system according to claim 1, further comprising a bi-directional player communication unit (PCU) integrated with a wearable article of the user to communicate the second identification information and user-gesture-information with the controller unit through the interface.

5. The system according to claim 2, wherein the detection unit comprising:

a first Schmitt trigger to generate a clock signal on receiving the alternating voltage of the second electrode;

a second Schmitt trigger to generate a pulse signal having time interval associated with the electric field strength in between the play item and the play field; and a counter connected to the first Schmitt trigger and the second Schmitt trigger for generating a digital value indicating the surface information of the play item and the position information of the play item.

6. The system according to claim 1, wherein the controller unit further sends a command data to at least one of the play item; and the player communication unit (PCU) through the interface for signalizing the status of the play item.

7. The system according to claim 1, wherein the memory unit further stores the processed-game-play-data associated with the game play performed by the user.

8. The system according to claim 2, wherein the play item further comprising:

an optical unit to generate an optical signal for signaling the status of the play items;

a vibration unit to cause a vibration signal for signaling the status of the play items; and an audio unit to generate an audio signal for signaling the status of the play items.

9. An electronic game board system communicating game-play-data over a communication network, the system comprising:

a contactless communication unit communicating over a communication network to provide alternating electric field;

an electronic game board having plurality of the play fields to receive the alternating electric field; and one or more play items capacitively coupled to the contactless communication unit, further the play items transmit the game-play-data to the contactless communication unit;

wherein the contactless communication unit comprising:

a generator to receive power from a DC source for generating a low level alternating voltage;

a first converter to shift the low level alternating voltage received from the generator to high level alternating voltage;

a first electrode connected to the converter for emitting high level alternating electric field of specific frequency;

a memory unit to store reference data associated with the play item and the electronic game board;

an interface to receive the game-play-data transmitted from the play item caused by the user interaction;

a controller unit to process the game-play-data received from the interface by comparing the reference data with the game-play-data and further transmits the processed game-play-data to the interface; and a display unit to display the processed-game-play-data defining the status of the play item received from the interface;

an electronic game board having plurality of the play fields to receive the alternating electric field, wherein the playfields serially interconnected with each other; and one or more play items capacitively coupled to the contactless communication unit, the play item comprising:

at least a second electrode to receive the alternating electric field emitted from the first electrode, and further receiving the trigger signal from gesture of the user;

a floating electrode to float the alternating electric field to the ground for forming a closed electric circuit with at least one of: the CCU; and the user;

a second converter to convert the alternating voltage received from the second electrode to the direct voltage;

a buffer to store the direct voltage received from the second converter;

a detection unit to detect the game-play-data associated with at least one surface of the play item, position of the play item on the play field, and a first identification information of the play item; and a modulator to modulate the alternating electric field influenced by the first electrode with the detected data, and further transmits the modulated data to the interface.

10. The system according to claim 9, further comprising a bi-directional player communication unit (PCU) integrated with a wearable article of the user to transmit the second identification information and gesture information associated with the user.

11. The system according to claim 9, wherein the detection unit comprising:

a first Schmitt trigger to generate a clock signal on receiving the alternating voltage of the second electrode;

a second Schmitt trigger to generate a pulse signal having time interval associated with the electric field strength in between the play item and the play field; and a counter connected to the first Schmitt trigger and the second Schmitt trigger for generating a digital value indicating the surface information of the play item and the position information of the play item.

12. The system according to claim 9, wherein the controller unit further sends a command data to the play item and the player communication unit (PCU) through the interface for signalizing the status of the play item.

13. The system according to claim 9, wherein the memory unit further stores the processed-game-play-data associated with the game play performed by the user.

14. The system according to claim 9, wherein the play item further comprising:

an optical unit to generate an optical signal for signaling the status of the play items;

a vibration unit to cause a vibration signal for signaling the status of the play items; and an audio unit to generate an audio signal for signaling the status of the play items.

15. The system according to claim 9, wherein the play item further comprising a flexible polymer foil for embedding the second electrode, the floating electrode, the second converter, the buffer, the detection unit, and the modulator of the play item.

16. An electronic game system communicating game-play-data, the system comprising:

a contactless communication unit to display plurality of play fields associated with a game, and further to provide alternating electric field;

one or more play items capacitively coupled to the contactless communication unit, further the play items transmit the game-play-data to the contactless communication unit;

wherein the contactless communication unit comprising:

a generator to receive power from a DC source for generating a low level alternating voltage;

a first converter to shift the low level alternating voltage received from the generator to high level alternating voltage;

a first electrode connected to the converter for emitting high level alternating electric field of specific frequency;

a memory unit to store reference data associated with the play item;

an interface to receive the game-play-data transmitted from the play item caused by the user interaction;

a controller unit to process the game-play-data received from the interface by comparing the reference data with the game-play-data and further transmits the processed game-play-data to the interface; and a display unit to display the processed-game-play-data defining the status of the play item received from the interface;

one or more play items placed on the play fields displayed on the contactless communication unit, the play item comprising:

at least a second electrode to receive the alternating electric field emitted from the first electrode, and further receiving the trigger signal from gesture of the user;

a floating electrode to float the alternating electric field to the ground for forming a closed electric circuit with at least one of: the CCU; and the user;

a second converter to convert the alternating voltage received from the second electrode to the direct voltage;

a buffer to store the direct voltage received from the second converter;

a detection unit to detect the game-play-data associated with at least one surface of the play item, position of the play item on the play field, and a first identification information of the play item; and a modulator to modulate the alternating electric field influenced by the first electrode with the detected data, and further transmits the modulated data to the interface.

17. The system according to claim 16, further comprising a player communication unit (PCU) integrated with a wearable article of the user to transmit the second identification information and gesture information associated with the user, and further receives the command data signalizing the status of the play items from the controller unit through the interface.

18. The system according to claim 16, wherein the detection unit comprising:

a first Schmitt trigger to generate a clock signal on receiving the alternating voltage of the second electrode;

a second Schmitt trigger to generate a pulse signal having time interval associated with the electric field strength in between the play item and the play field; and a counter connected to the first Schmitt trigger and the second Schmitt trigger for generating a digital value indicating the surface information of the play item and the position information of the play item.

19. The system according to claim 16, further comprising an electronic game board to receive the alternating electric field; wherein the play items placed on the electronic game board transmit the game-play-data to the contactless communication unit.

* * * * *